United States Patent [19]

Witte et al.

[11] 4,155,637

[45] May 22, 1979

[54] DEVELOPING APPARATUS FOR DEVELOPING DIAZOTYPE MATERIAL ACCORDING TO THE SEMI-DRY PROCESS

[75] Inventors: Horst Witte, Naurod; Artur Broze, Wiesbaden, both of Fed. Rep. of Germany

[73] Assignee: Hoechst Aktiengesellschaft, Fed. Rep. of Germany

[21] Appl. No.: 920,991

[22] Filed: Jun. 30, 1978

[30] Foreign Application Priority Data

Jun. 30, 1977 [DE] Fed. Rep. of Germany ..... 2729523

[51] Int. Cl.[2] ..... G03D 5/06

[52] U.S. Cl. ..... 354/318; 118/249; 118/261

[58] Field of Search ..... 354/318, 324; 118/249, 118/250, 261

[56] References Cited

U.S. PATENT DOCUMENTS

| | | | |
|---|---|---|---|
| 3,245,381 | 4/1966 | Brenneisen et al. | 118/249 |
| 3,626,833 | 12/1971 | Koch | 118/261 |
| 3,748,996 | 7/1973 | Kobayashi | 354/318 |
| 3,875,581 | 4/1975 | Yamashita et al. | 354/318 |

FOREIGN PATENT DOCUMENTS

| | | | |
|---|---|---|---|
| 2209865 | 9/1973 | Fed. Rep. of Germany | 354/318 |

*Primary Examiner*—Stephen J. Tomsky
*Assistant Examiner*—Alan Mathews
*Attorney, Agent, or Firm*—James E. Bryan

[57] ABSTRACT

An apparatus for developing diazo material according to a semi-dry process comprising an applicator roll with a liquid absorbing cover, a press roll having a grooved hard surface, a backing roll biased against the press roll, and a blade for reducing the amount of developer liquid on the applicator roll and the press roll. The press roll is displaceable toward the applicator roll. The plane of transport of the diazo material to be developed passes between the applicator roll and the press roll. The axial moment of inertia of the press roll relative to the axial moment of inertia of the applicator means is determined in accordance by an equation containing weight components of the press roll, weight components of the applicator roll, the contact pressure component of the backing roll, and the sum of the components of the tangential force and normal force of the contact pressure of the blade and the frictional force along the line of contact of the blade on the applicator roll.

6 Claims, 5 Drawing Figures

Figure 1:
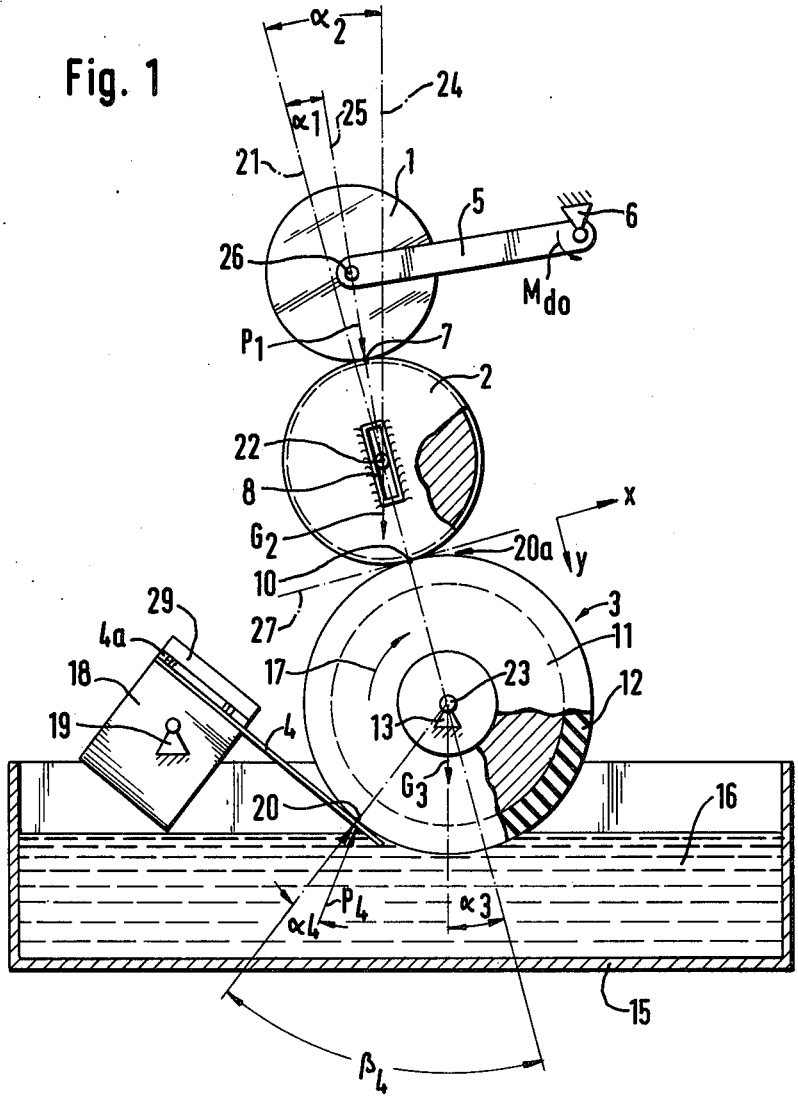

DEVELOPING APPARATUS FOR DEVELOPING DIAZOTYPE MATERIAL ACCORDING TO THE SEMI-DRY PROCESS

The invention relates to a developing apparatus for developing diazotype material according to the semi-dry process.

In developing apparatus operating according to the semi-dry process the problem exists that a layer of developer liquid which is as thin as possible, must be applied to the imagewise exposed surface of the diazotype material, and that this layer should, as far as possible, be of uniform thickness. As is known, it may, e.g., be desired to apply less than 3 grams/m$^2$ of developer liquid to the surface of the diazotype material. If these requirements are not met, the developed diazotype material will either leave the developing apparatus in an undesirably damp or wet condition, so that it will be necessary to provide a device for drying the diazotype material, or the diazotype material will be unequally developed over its surface.

A developing apparatus of the above-mentioned type has already been described (DE-OS No. 2,209,865). This apparatus comprises three rotatable rollers arranged in parallel with one another so as to form a row, with the neighboring rollers contacting each other. One of the rollers positioned at one end of the row is rotatably supported in stationary bearings, whereas the other two rollers may be moved towards or away from their respective neighboring rollers. In order to press the rollers together, a device is provided which exerts pressure upon the roller situated at the opposite end of the row with respect to the stationarily supported rotatable roller. The means for applying and spreading the developer liquid act together with the roller in the middle of the roller arrangement. In detail, the means for applying and spreading the developer liquid comprises a felt applicator strip one end of which is immersed in a developer trough, while the other end is, with the aid of a spring, pressed against the central roller which may, e.g., be made of rubber (rubber roller).

Apart from the central rubber roller, the roller arrangement includes the stationarily supported rotatable back pressure roller on one side of the rubber roller, and a squeeze roller on the opposite side of the rubber roller. The squeeze roller and the rubber roller are displaceable in the direction of the back pressure roller. A back-up roller arranged in series with the roller arrangement contacts the squeeze roller at the outside of the row and presses it, together with the rubber roller, against the back pressure roller. The back-up roller exerts pressure in the central part of the circumferential area of the squeeze roller. Even in case of deflection of the squeeze roller, the rubber roller, and the back pressure roller, the pressure exerted by the back-up roller will act uniformly over the entire length of these rollers, provided they are of sufficient strength. This arrangement having a small working width is based on the knowledge that the developer liquid is uniformly applied to the circumference of the rubber roller by the three rollers (squeeze roller, rubber roller, and back pressure roller), even if the back-up roller exerts an unequally distributed pressure upon the squeeze roller. This is due to the fact that the developer liquid collects meniscuslike at the line of contact between the rubber roller and the squeeze roller. While pressure is transmitted via the squeeze roller and the rubber roller, a uniform distribution of pressure is produced along the line of contact between the rubber roller and the back pressure roller.

A leaf-type spring forces the felt applicator strip against the rubber roller, producing a uniform pressure over the entire length of that roller. It is intended that, in connection with the squeeze roller which removes any excess developer liquid at the line of contact on the rubber roller, only a minimum amount of developer liquid is applied to the diazotype material transported through a plane of transport formed between the back pressure roller and the rubber roller. In an alternative embodiment of the known developing apparatus, which has a large working width, the individual back-up roller is replaced by a number of back-up rollers for the uniform distribution of the pressure transmitted by the squeeze roller to the rubber roller and thence to the back pressure roller.

This prior art developing apparatus represents a roller frame including three rollers. As compared to a frame of two rollers and a single press roller it has the disadvantage of being relatively expensive.

There is further a prior art arrangement of two rollers (U.S. Pat. No. 3,626,833) comprising a lower roller partially submerged in a reservoir containing the developer liquid which is taken up by that roller, and an applicator roller contacting it from above. A wiper blade is pressed against the applicator roller which merely serves to transfer the developer liquid taken up by the lower roller and metered by the wiper blade to the diazotype material to be developed. The diazotype material passes between the upper roller provided with a rubber cover in order to retain the developer liquid and a pressure blade which makes contact with the applicator roller from above. An adequate dimensioning of the pressure blade will result in an approximately uniform pressure over the width of the pressure blade and the applicator roller, but the pressure blade tends to interfere with the synchronous motion of the diazotype material through the developing apparatus, so that the travelling speed of the diazotype material through the developing apparatus no longer corresponds to the constant speed at which the material is to be transported through the entire copying machine. To avoid this disadvantage of the pressure blade, a pressure roller may be used, which is known in itself. However, if the pressure blade were replaced by a pressure roller, a relatively expensive system of three rollers would result, which would render dimensioning difficult in view of the requirements of the semi-dry developing process.

The semi-dry process concerned is, in particular, intended for developing a two-component diazotype material using an alkaline liquid containing a proportion of an aliphatic amine; but it is also possible to develop in this manner a one-component diazotype material which contains only rapid coupling diazonium compounds. For developing a one-component material, a solution of an azo coupling component in a pre-metered quantity of about 1.5 to 4.5 cm$^3$/m$^2$ is added to the diazo layer (DE-OS No. 2,325,579). In this case, the solution of the azo coupling component can have a pH of about 14.

Based on a developing apparatus of the aforementioned type, it is an object of the present invention to provide a developing apparatus for diazotype material up to sizes of DIN A0 and above, which does not have the disadvantages of the above-described equipment, and which, at a minimum of expense, makes it possible to apply the developer liquid uniformly and in the smallest possible quantity to the diazotype material to be developed.

This developing apparatus has the advantage that a very thin and uniform layer of developing liquid may be applied to the diazotype material to be developed by means of an arrangement of two rolls including an applicator roll and a press roll, between which rolls diazotype material of large widths may be transported. A third roll for equalizing the pressure along the line of contact or over the widths of the rolls, is not necessary due to the dimensioning of the press roll and the applicator roll employed according to the invention. Further, it has been found that, for particular aqueous developers, the arrangement including two rolls and a backing roller can be perfectly adjusted to the desired amount to be applied in the range between 3 and 5 grams/m$^2$, in connection with a blade contacting the applicator roll, while it is far more difficult appropriately to dimension a three-roll system for that purpose. In addition, the two-roll system proposed by the present invention has the essential advantage that despite of the reduced but uniform application of aqueous developer solution, no pleats are formed when the diazotype material to be developed travels through the apparatus at high speed. Good results were achieved with sheets of DIN A0 size, fed in longitudinally or transversely.

It is, therefore, a primary feature of the present invention that a system of two rolls is provided for developing diazotype material according to the semi-dry process, the system comprising an applicator roll for metering and simultaneously applying a preferably aqueous developer solution to the diazotype material and a press roll for producing the required pressure along the line of contact between the two rolls, where the developer solution is applied, and an individual backing roller which contacts the press roll centrally—or several equivalently acting backing rollers arranged in the middle of the press roll—with the axial moments of inertia $J_2$ of the press roll and $J_3$ of the applicator roll being such that the deflections of these rolls are equal and a uniform pressure exists along their contact zone. The relationship between the moments of inertia is as follows:

$$\frac{J_2}{J_3} = 0.6 \cdot \frac{G_{2y} + P_{1y}}{G_{2y} + P_{1y} + G_{3y} + \Sigma P_{4zy}}$$

The axial moment of inertia $J_2$ of the press roll is determined by means of this equation, after the axial moment of inertia $J_3$ of the applicator roll has been fixed. The moment of inertia $J_3$ is fixed according to the outside diameter—for a hollow roll also according to the inside diameter—of the applicator roll, with these diameters being determined mathematically or experimentally, in view of the desired pressure between the press roll and the applicator roll and in view of the permissible deformation. In addition to the weight of the press roll, the desired pressure in the line of contact necessitates a particular contact pressure exerted upon the press roll by the backing roller and incorporated in the above equation for the moment of inertia $J_2$. Further, the sum of the components of the partial forces z of the blade for metering the developer liquid at the applicator roll, which extend in the direction of the connecting line of the axles of the press roll and the applicator roll have to be taken into consideration when calculating the axial moment of inertia of the press roll. The contact pressure of this blade is adjusted according to the amount of developer liquid to be applied. When calculating the moment of inertia of the press roll only those components of the forces acting upon the press roll and the applicator roll (weight of the press roll, weight of the applicator roll, contact pressure of the backing roller and contact pressure and frictional force of the blade) are of interest which act in the principal plane where the axles of the press roll and the applicator roll lie and at right angles with these axles, because it is in these directions that the principal forces act and deformations have the largest influence upon the distribution of pressure. These components marked by the index $_y$ are normal to the components with the index $_x$ of the weights and forces in the plane of transport or in parallel therewith.

The latter are preferably such that small or equal and equidirectional deflections result for the press roll and the applicator roll.

The deflection of the press roll can be influenced by the direction in which the contact pressure of the backing roller acts and the deflection of the applicator roll can be influenced by the point of attack and the direction of the metering force and the frictional force.

The last-mentioned factors which influence the deflection of the applicator roll are, at the same time, important for the metering of the developer. They may be experimentally determined.

The inclination of the principal plane is determined by the stipulation that the coated side of the copying material is to face downwardly and by the desired transport direction of the copying material.

In one embodiment of the developing apparatus employing the two-roll system, the applicator roll is provided with a liquid-adsorbing elastic cover and the press roll has a grooved hard surface. The amount of liquid to be applied to the diazotype material is determined according to the contact pressure of the metering blade and the surface roughness or the properties, of the elastic cover. By the counterpressure of the hard press roll this amount of liquid is practically completely transferred to the diazotype material without forming a meniscus-type accumulation of liquid at the contact line.

For a uniform application, a constant pressure along the line of contact of the press roll on the applicator roll is required, and also a uniform metering along the line of contact of the blade at the applicator roll. Accordingly, the blade is preferably dimensioned such that its deflection at the line of contact on the applicator roll is equal to the deflection of the applicator roll in this area. This is particularly appropriately achieved by providing a blade support equipped with a tightening bar which is adjustable to obtain a uniform contact pressure along the axially extending line of contact between the blade and the applicator roll. In an alternative embodiment the tightening bar is fastened to the blade support at two opposite ends in the direction of the line of contact, and its distance from the blade support may be adjusted by a screw located midway between the two ends.

An adequate application of the developer liquid to the diazotype material does not depend only upon the compliance with the above-described conditions, namely pressure and deflection along the line of contact in the direction of the connecting line between the axles of the press roll and the applicator roll; in addition, the components of pressure and deflection extending perpendicularly thereto in the direction of the plane of transport must appropriately correspond to particular requirements. For this purpose, the directions of attack of the contact pressure exerted by the press roll upon the applicator roll and of the contact pressure of the blade are preferably arranged in such a manner that the deflections of the press roll and the applicator roll in the direction of the plane of transport normal to the direction of the principal plane, in which the axles of the press roll and the applicator roll lie, are approximately zero.

An alternative embodiment of this developing apparatus is appropriately dimensioned such that the deflections of the press roll and the deflection of the applicator roll in the direction of the plane of transport have the same direction and are equal in magnitude. In a further embodiment of the developing apparatus, several backing or pressing rollers exerting an almost punctiform load on the press roll may be provided in the central area of the press roll, instead of a single backing or pressing roller bearing upon the middle of the press roll. In this case, the pressure between the individual backing roller and the press roll is reduced, but the above-mentioned determination of the moment of inertia of the press roll for obtaining constant deflections and pressures along the line of contact on the applicator roll still represents a good approximation.

Figure 2:
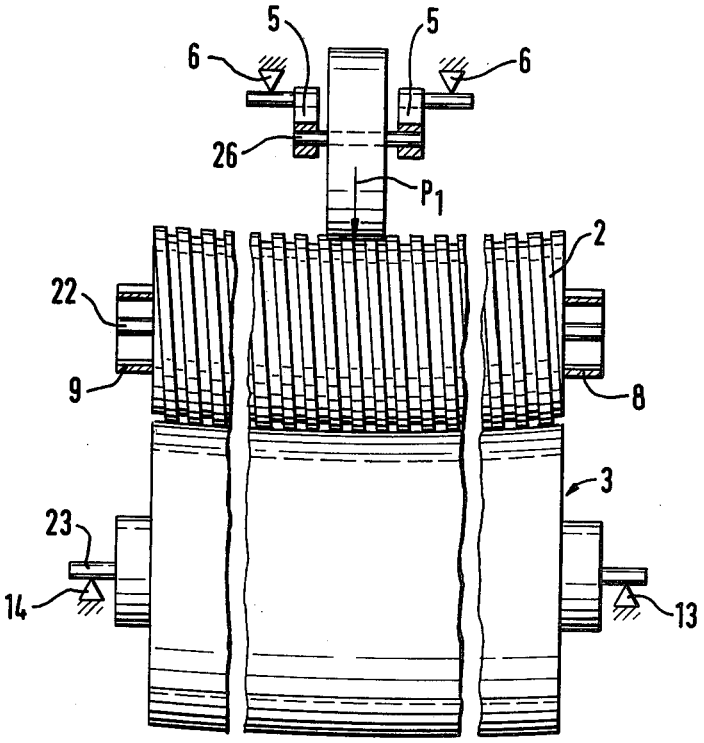
Figure 3:
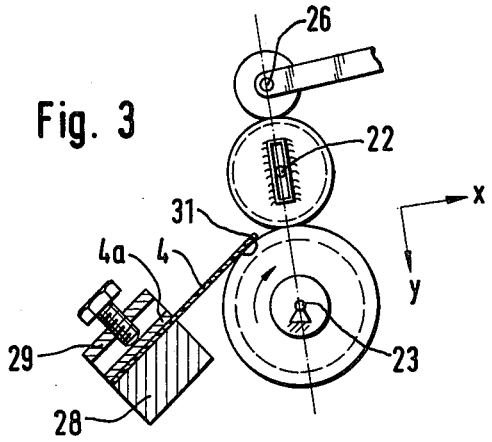
Figure 4:
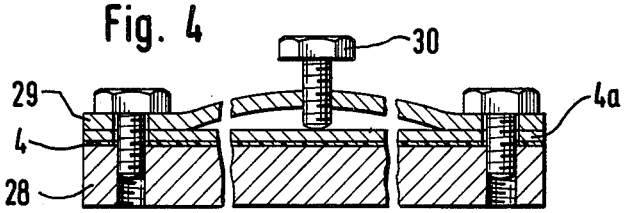
Figure 5:
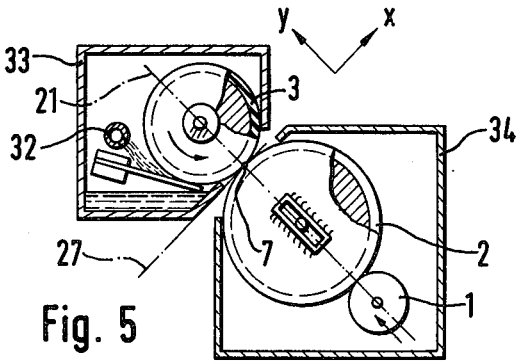

Below, preferred embodiments of the invention are described by reference to the accompanying drawings including five figures, in which identical parts are marked with the same reference numerals. In these figures FIG. 1 is a side view of one embodiment of the developing apparatus (partly in section), FIG. 2 is a schematic front view of the developing apparatus according to FIG. 1, FIG. 3 shows another embodiment of the developing apparatus in a schematic side view (partly centrally sectioned), FIG. 4 shows a detail of FIG. 3 in a longitudinal section and FIG. 5 is a schematic side view of still another embodiment of the developing apparatus.

FIG. 1 shows a backing roller 1 which bears upon the middle of a press roll 2. The arrangement of rolls is completed by an applicator roll 3 contacted by a metering blade 4.

In detail, a torsional moment $M_{do}$ acts upon the backing roller 1 which is supported by a flexible shaft 5 and is pivotal about a bearing 6. Together with the weight of the backing roller 1 the torsional moment $M_{do}$ determines the contact pressure $P_1$ in the place of contact 7 between the backing roller and the press roll.

The press roll 2 is made of steel and has a grooved shell surface. It is guided by the guiding elements 8 and 9 in the common principal plane, in which the axles of the press roll 2 and the applicator roll 3 lie. The vector of the weight of the press roll is indicated by an arrow $G_2$. The press roll bears upon the applicator roll along the line of contact 10.

The applicator roll is a hollow roll comprising a core 11 of steel and a liquid adsorbing cover 12, for example made of rubber. It is rotatably supported in the stationary bearings 13 and 14, in such a manner that the cover is immersed in a developer liquid 16 contained in a trough 15.

The applicator roll is driven to rotate in the direction of the arrow 17, and it takes up a certain amount of developer from the trough 15, which is metered by the metering blade 4 extending along the line of contact 20 on the applicator roll. The metering blade is composed of a synthetic material or of steel coated with a synthetic material and is over its length fastened to a blade support 18 by means of a clamping bar, not shown. Together with the blade support the blade is pivotal about two stationary bearings, with the bearing 19 being schematically shown in FIG. 1. The blade is pressed against the applicator roll obliquely from below along the line of contact 20, and it exerts the total force $P_4$. FIG. 1 further shows three chain-dotted lines indicating planes which are normal to the plane of the drawing. One of these lines represents the principal plane 21, in which the axles 22 and 23 of the press roll and the applicator roll lie. The principal plane 21 and the perpendicular plane 24 enclose the angle of incline $\alpha_2$. The plane 25 which is indicated by another line includes the axle 22 of the press roll and the axle 26 of the backing roller. The angle formed between the direction of the contact pressure $P_1$ and the principal plane 21 is marked $\alpha_1$; and the angle formed between the vector of weight $G_3$ and the principal plane 21 is marked $\alpha_3$.

FIG. 1 further shows the plane of transport 27 which, in the passing gap 20*a* between the press roll and the applicator roll, extends at a right angle with the plane 21. The passing gap has its narrowest point at the contact line 10.

FIG. 1 also shows the directions of the x and y coordinates in the plane of transport and in the principal plane and, finally, the angle $\beta_4$ formed between the point of contact of the blade and the principal plane and the angle $\alpha_4$ formed between the direction of the contact pressure and the normal passing through the point of contact of the blade.

If the axial moments of inertia $J_2$ and $J_3$ of the press roll and of the applicator roll are dimensioned as specified, a uniform pressure will exist along the line of contact 10 in the passing gap between the press roll 2 and the cover 12 of the applicator roll. As a consequence, the uniform layer of developer liquid produced by the blade 4 is uniformly transferred to the diazotype material which is transported through the passing gap between the press roll 2 and the applicator roll 3.

The specific data for a preferred arrangement of rolls according to FIG. 1 are given below, with the axial moments of inertia being coordinated according to the dimensioning rule given:

| | | |
|---|---|---|
| length of contact l: | 132 | cm |
| inside diameter of the applicator roll | 1.75 | cm |
| outside diameter of the applicator roll | 4.00 | cm |
| axial moment of inertia $J_3$ of the applicator roll | 12.1 | $cm^4$ |
| desired load in the line of contact 10 as a sum of the weight component of the weight $G_2$ of the press roll in the y-direction and the contact pressure component $P_1$ in the y-direction | 369.6 | N |
| dead weight component of the weight $G_3$ of the applicator roll in the y-direction | 114 | N |
| force component in the y-direction exerted by the metering blade upon the applicator roll | −33.3 | N |

Accordingly, the data given are taken into consideration when combining the press roll with the applicator roll, so that the deflection of the press roll is equal to the deflection of the applicator roll:

| | | |
|---|---|---|
| axial moment of inertia $J_2$ | 5.96 | $cm^4$ |

-continued

| | | |
|---|---|---|
| body diameter of the press roll in the case of a solid cross-section | 3.32 | cm |
| Further, the component of the weight $G_2$ of the press roll in the y-directon results in | 90.9 | N |
| and thus the required contact pressure component in the y-direction is | 278.7 | N |

The embodiment of the developing apparatus according to FIG. 3 differs from the embodiments according to FIGS. 1 and 2 mainly in that the metering blade 4 is pressed upon the applicator roll from above, so that a force component in the y-direction is exerted upon the applicator roll, extending in the opposite direction with respect to the corresponding force component in FIG. 1. In addition, the axles 22, 23 and 26 of the rolls and the backing roller are in the principal plane.

FIG. 3 and, specifically, FIG. 4 show a blade support 28 which is equipped with a stiffening bar 4*a* and a tightening bar 29.

The two extremities of the tightening bar are firmly bolted to the blade support, whereas the middle of the blade support exerts an additional force upon the blade by an adjustable screw 30 provided in the tightening bar. As a result, the blade is particularly easily adjusted so that its deflection corresponds to the deflection of the applicator roll at the line of contact 31. The cross-section of the blade support may be kept relatively small. By this measure the direction of deflection is reversed.

FIG. 5 shows a third embodiment of the developing apparatus for developing copying material in which the coated side faces upwardly. In this case, the applicator roll 3 is arranged above the press roll 2, while the backing roller 1 is pressed against the press roll obliquely from below. The developer liquid is uniformly supplied to the applicator roll by way of a perforated feed line 32, dispensing the developer liquid to the metering blade which is arranged in an inclined position below the applicator roll and is pressed against that roll. The applicator roll, the metering blade and the perforated feed line are housed in an upper casing 33 which, at the same time, serves as a collecting trough for the developer liquid. The plane of transport 27 for the diazotype material to be developed extends between the upper casing 33 and a lower casing 34 and between the press roll and the applicator roll. Also in this case, the axial moment of inertia $J_3$ of the applicator roll is determined according to the inventive dimensioning rule, taking into consideration an inversion of signs for some of the forces, in view of the configuration of the rolls.

It will be obvious to those skilled in the art that many modifications may be made within the scope of the present invention without departing from the spirit thereof, and the invention includes all such modifications.

What is claimed is:

1. A developing apparatus for developing diazotype material according to the semi-dry process comprising an applicator roll means having a liquid-adsorbing resilient cover thereon, a press roll means having a grooved hard surface, and a backing roll means, said applicator roll means and said press roll means having a plane of transport between them for the passage of diazotype material to be developed, means biasing said backing roll means against said press roll means, means whereby said press roll means may be displaced toward said applicator roll means, blade means for reducing the amount of developer liquid on said applicator roll means and said press roll means, and the axial moment of inertia $J_2$ of said press roll means relative to the axial moment of inertia $J_3$ of the applicator roll means being determined in accordance with the equation:

$$\frac{J_2}{J_3} = 0.6 \cdot \frac{G_{2y} + P_{1y}}{G_{2y} + P_{1y} + G_{3y} + \Sigma P_{4zy}}$$

wherein:

$G_{2y}$=the weight component of the press roll means, extending in a connecting plane of axes of the press roll means and the applicator roll means, normal to the axes, $G_{3y}$=the weight component of the applicator roll means, extending in the connecting plane of the axes of the press roll means and the applicator roll means, normal to the axes, $P_{1y}$=the contact pressure component of the backing roll, extending in the connecting plane of the axes of the press roll means and the applicator roll means, normal to the axes, and $\Sigma P_{4zy}$=the sum of the components of the tangential force and the normal force of the contact pressure of the blade means, and of the frictional force along the line of contact of the blade means on the applicator roll means, resulting from the normal force and the friction coefficient, which extend in the connecting plane of the axes of the press roll means and the applicator roll means, normal to the axes.

2. A developing apparatus according to claim 1 in which the applicator roll means is a hollow roll having a steel core, and the press roll means is also made of steel.

3. A developing apparatus according to claim 1 including a plurality of backing roll means in the central area of the press roll means, which backing roll means exert an approximately punctiform load upon the press roll means.

4. A developing apparatus according to claim 1 including a blade support carrying the blade means, and tightening bar means which may be adjusted to provide a uniform contact pressure along the line of contact of the blade means extending in an axial direction on the applicator roll means.

5. A developing apparatus according to claim 1 in which the directions of the contact pressure of the press roll means on the applicator roll means and of the contact pressure of the blade means are arranged in such a manner that deflections of the press roll means and of the applicator roll means are approximately zero in the direction of said plane of transport at a right angle with the direction of the principal plane in which axes of the press roll means and of the applicator roll means lie.

6. A developing apparatus according to claim 1 in which deflection of the press roll means and deflection of the applicator roll means in the direction of said plane of transport extend in the same direction and are equal in magnitude.

* * * * *